US006491014B1

(12) United States Patent
Eickert

(10) Patent No.: US 6,491,014 B1
(45) Date of Patent: Dec. 10, 2002

(54) VALVE COVER ASSEMBLY FOR INTERNAL COMBUSTION ENGINE

(76) Inventor: Keith Eickert, 11 Industry Dr., Palm Coast, FL (US) 32137

( * ) Notice: Subject to any disclaimer, the term of this patent is extended or adjusted under 35 U.S.C. 154(b) by 0 days.

(21) Appl. No.: 09/650,981

(22) Filed: Aug. 30, 2000

(51) Int. Cl.[7] ..... F02F 7/00
(52) U.S. Cl. ..... 123/195 C
(58) Field of Search ..... 123/195 C

(56) References Cited

U.S. PATENT DOCUMENTS 4,215,665 A * 8/1980 Stambaugh ..... 123/195 C
4,294,333 A * 10/1981 Little ..... 123/195 C
4,788,950 A * 12/1988 Finley ..... 123/195 C
5,241,934 A * 9/1993 Laimbock ..... 123/195 C
5,279,265 A * 1/1994 Matsuo et al. ..... 123/195 C

* cited by examiner

*Primary Examiner*—Noah P. Kamen
*Assistant Examiner*—Jason Benton
(74) *Attorney, Agent, or Firm*—Robert M. Downey, P.A.

(57) ABSTRACT

A valve cover assembly for use on an internal combustion engine includes an adapter ring structured and disposed for mating and sealing attachment to the engine block in surrounding relation to cylinder openings, a removable cover which sealingly engages with the adapter ring in order to enclose the cylinders and valves of the engine, an O-ring seal for sealing the cover and the adapter ring when in assembly, and a quick release mechanism to releasably connect the cover to the adapter ring and allowing for quick removal of the cover in order to gain access to the engine interior without the need of first removing associated engine parts.

5 Claims, 5 Drawing Sheets

VALVE COVER ASSEMBLY FOR INTERNAL COMBUSTION ENGINE

BACKGROUND OF THE INVENTION

1. Field of the Invention

This invention relates to a valve cover assembly for an internal combustion engine adapted to be installed in a confined space on a vehicle. Particularly, this invention relates to a valve cover assembly for use on the block of an internal combustion engine which includes associated engine parts installed in close adjacent relation to the block defining a confined access space between the block and the associated engine parts. And, more particularly, the valve cover assembly of this invention is sized to be carried on the engine block in the confined access space between the block and the aforesaid associated engine parts. The invention, in general, includes: A) an adapter ring designed and configured to mate sealingly and peripherally about the cylinder openings in the engine block; B) a removable cap which sealingly engages with the adapter ring in order to enclose the cylinders and valves in the block; and C) quick release means to releasably connect the cap to the adapter ring for removal of it to gain access to the engine interior without the need of first removing the associated engine parts, removal of which is a time-consuming and expensive task.

2. Discussion of the Related Art

Vehicular driving internal combustion engines, whether for land vehicles or inboard marine engines, ordinarily include one or two cylinder heads which are disposed longitudinally on the engine. In either case, each includes a cover, which is sized and configured to mate with the cylinder blocks in covering relation of the valves above the cylinders. A companionate gasket is provided between the head and the cylinder block to prevent leakage of oil. Usually 8 or 10 threaded and spaced bolts secure each cylinder head to the engine block.

At times, inspection, adjustment, service, or repair of the engine is required; and, accordingly, access is required to the engine interior, which dictates removal of a cylinder head. However, because the configuration of many automotive and marine engines and their attached or associated engine parts or components are required to fit in a confined engine space, access, even to the bolts, is difficult, if not impossible, without removal of some of the attached components, such as the exhaust manifold. This is very often the case with high-performance engine installations which are equipped with elaborate exhaust systems carried in close adjacent relationship to the cylinder head and engine block. This makes removal of exteriorly carried components, for example, the exhaust system, in whole or in part, a required and first task. This first task requires substantial time and expense which if avoided, might be an otherwise relatively minor and rapidly performed job.

In the past, efforts have expended to reduce the overall space of a vehicle required for its driving engine and the relatively small or tight space between the engine proper and its associated engine parts or components. These efforts have resulted in many prior patents having been granted in what has grown to be a relatively crowded art. A representative prior patent of structure to reduce required engine space, especially for high-performance engines, is found in U.S. Pat. No. 4,788,950 to Finley, which describes an assembly to cover an engine block's cylinder openings. That patent describes an assembly which includes a cover hingedly connected to a ring, which cover, in use, swings open on one side only, namely the swinging side, to permit some engine interior access. The entire cylinder head assembly, and all parts of the assembly, however, remain attached to the engine, limiting interior engine access. Moreover, sufficient room is needed to allow for the swinging movement of the cover to an open position. On engine assemblies which include associated engine parts in close adjacent relation to the block, such as exhaust manifolds, it may not be possible to hingedly open the Finley valve cover without first disassembling and removing the adjacent associated engine parts.

The recurring problem of access for machinery parts is generally described in the referenced patent. In addition to this problem, there is the problem, often encountered, of damage to a gasket, conventionally sandwiched between the cover and the engine block, and the need to replace it each time engine interior access is achieved.

Thus, those in the field continue to be concerned with the need for rapid adjustment of an internal combustion engine and reflect continuing efforts to reduce the size of the space between an installed internal combustion engine proper and its associated parts, while on a vehicle. This invention provides improved structure to meet these problems in the field.

SUMMARY OF THE INVENTION

Generally, this invention addresses these and related problems by providing a valve cover assembly composed essentially of two main parts, a ring adapter and a mating and completely removable ring cover. In use, a ring with a first main face is positioned on an engine block about the cylinder openings and attached to the block by bolts or screws with a gasket therebetween. The ring has a sealing groove in its outer main face to receive the rim of the cover in sealing relation therein. An O-ring is captivated in the groove, as is explained in more detail in the following specification and attached drawings. The cover is attached to the adapter by quick release means, constituting in the described embodiment, two captured screws in two vertical bores, one bore in each end of the cover with the bolts being in threaded engagement in bores in the adapter ring. Thus, tightening these screws attaches the cover to the ring in sealing relation and loosening of it lifts the cover out of the groove so it can be completely removed from the block and the confined access space between the ring and the associated exterior engine parts without disturbing the gasket between the ring and engine block.

This structure is in contrast to the aforementioned patent disclosure. The instant invention provides an improved structure that enables complete and rapid removal of a cover member of a valve cover assembly, as well as providing for rapid replacement of it. In general, the invention provides an improved valve cover as is described more fully herein.

The valve cover assembly of this invention is sized and structured to fit in the tight or confined access space between an installed engine block of an engine and other associated engine parts, such as the engine's exhaust manifold members. The structure of the assembly, described hereinafter, not only permits it to be installed in an optimally small space between the engine block and associated engine parts; but, also, it permits removal of the cover proper of the assembly to gain access to the inner parts of the engine through the ring adapter for fine tuned engine adjustments without requiring the associated engine parts to be removed as a first task of doing this job. It will be appreciated that avoiding removal of the associated engine parts saves time, which is important in ordinary work, and is, indeed, vital in a racing situation. Thus, the assembly of this invention is especially practical for a high-performance engine.

In summary, the valve cover assembly is sized to be carried on the engine between the block and the aforesaid engine parts; and it includes: A) an adapter ring designed and configured to mate peripherally about the cylinder openings in the engine block; B) a removable cover or cap, as described below, structured for sealing engagement with the adapter ring to cover and enclose the valves and the cylinder openings in the block; and C) quick release means connecting the cap to the ring for gaining access without the need of removal of the engine parts to adjust the engine.

OBJECTS OF THE INVENTION

Without intention of being limited, it is accordingly a general object of this invention to describe and provide a valve cover assembly according to a preferred embodiment which provides for rapid access to the interior parts of an engine installed in a confined space, or to be installed in such a space, on a vehicle.

It is a general object of this invention to provide a valve cover assembly sized to dwell on an engine block between the block and associated engine parts which includes an adapter ring designed and configured to mate peripherally about cylinder openings in the block, a removable cover or cap in sealing engagement with the adapter ring, which covers valves and cylinders in the block, and quick release means connecting the cap to the ring for gaining access without the need for removal of the engine parts to adjust, inspect or service the engine interior parts.

It is a general object of this invention to provide a valve cover assembly for the purposes described which is compact, simple to assemble, easily installed, and which provides for efficient use of space between an internal combustion engine block and associated engine parts; and a further object being to provide for rapid access to the engine interior for inspection, adjustments and repairs without the need of expensive and time consuming removal and repositioning of associated engine parts in order to achieve such adjustments.

BRIEF DESCRIPTION OF THE DRAWINGS

In accordance with these and other objects which will be apparent to those skilled in this field, the invention will be described in the following paragraphs on reference to the accompanying illustrations which are here described generally in the following figure descriptions and in more detail in the written description, or specification part of this application, which follows.

Like reference numerals refer to like parts throughout the several views of the drawings.

DETAILED DESCRIPTION OF THE PREFERRED EMBODIMENT

Figure 1A:
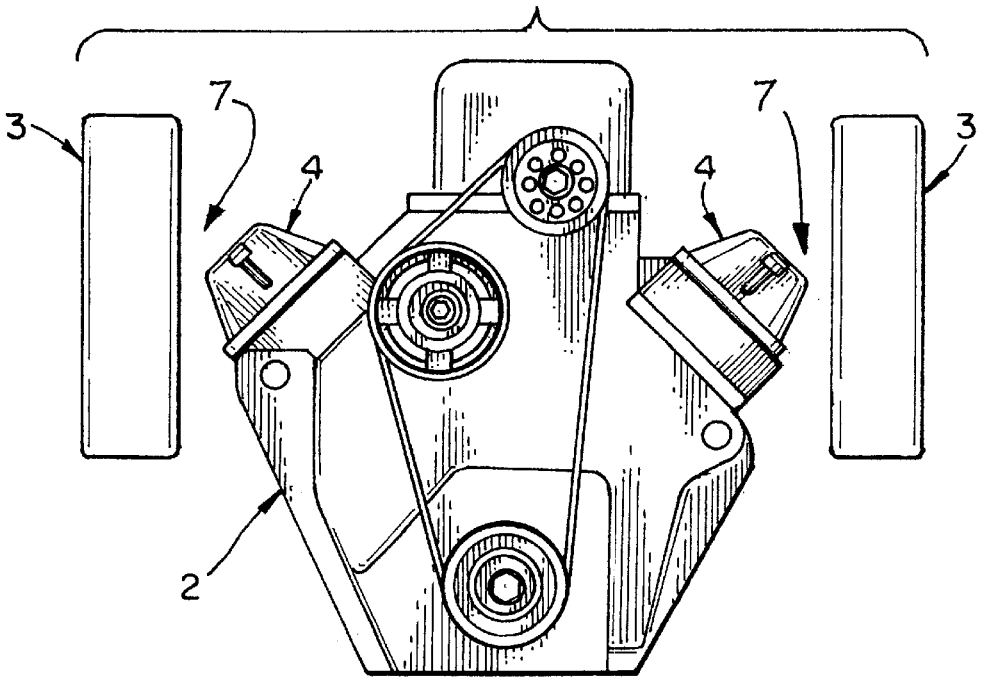
FIG. 1A is a diagram to illustrate an arrangement of an engine block, associated engine parts and the valve cover assembly therebetween.
Figure 1B:
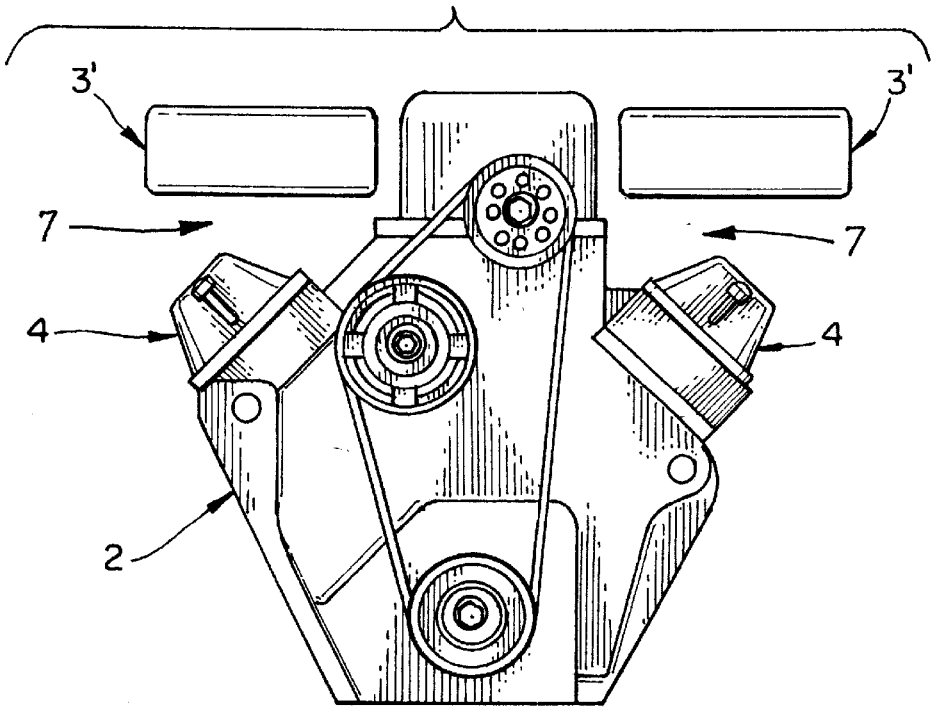
FIG. 1B is another illustration representing the engine block with a different arrangement of the associated engine parts relative to the engine block and the cylinder head.
Figure 3:
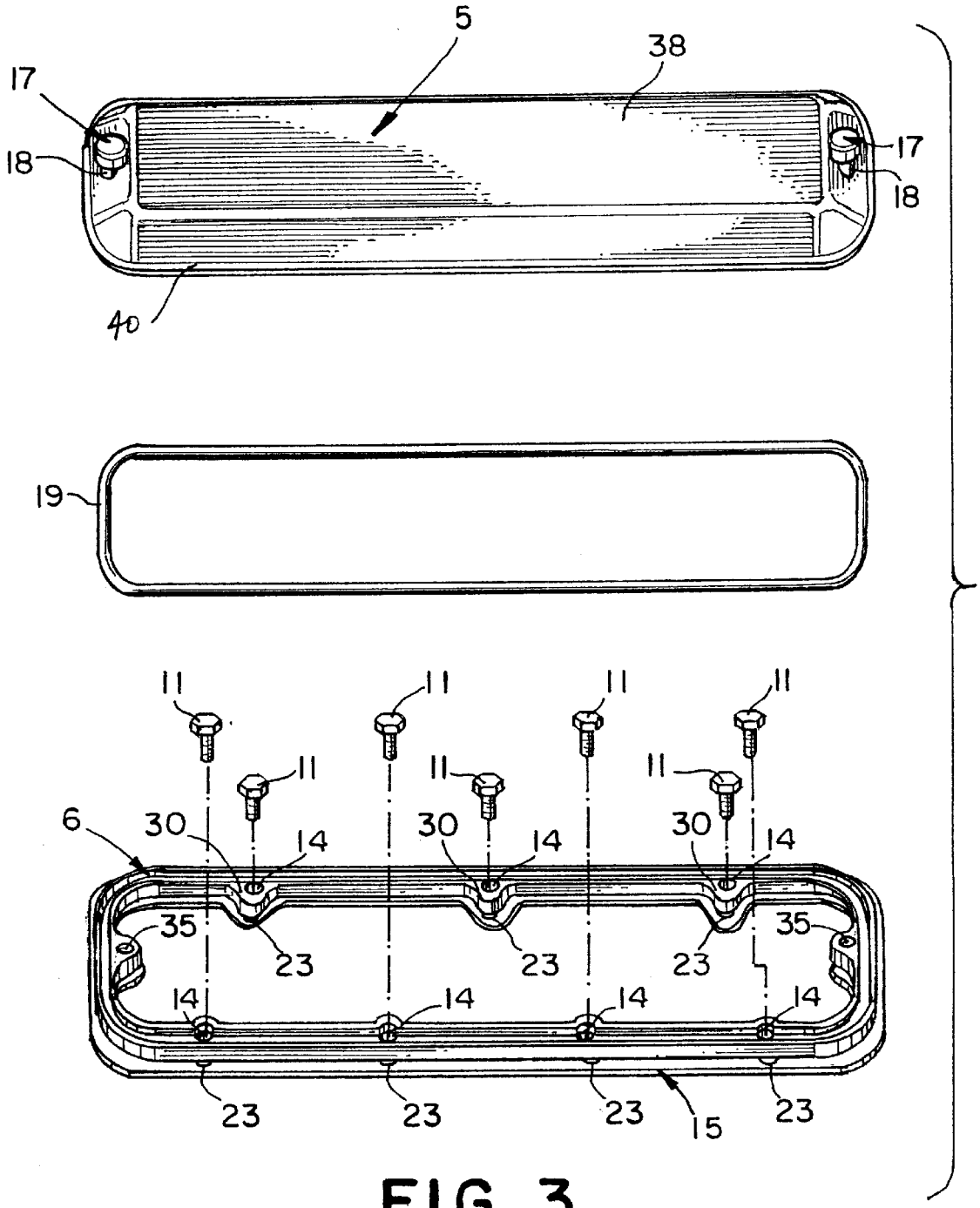
FIG. 3 is an exploded perspective view showing the component elements of the valve cover assembly including a cover, a ring adapter, and an O-ring seal.
Figure 5:
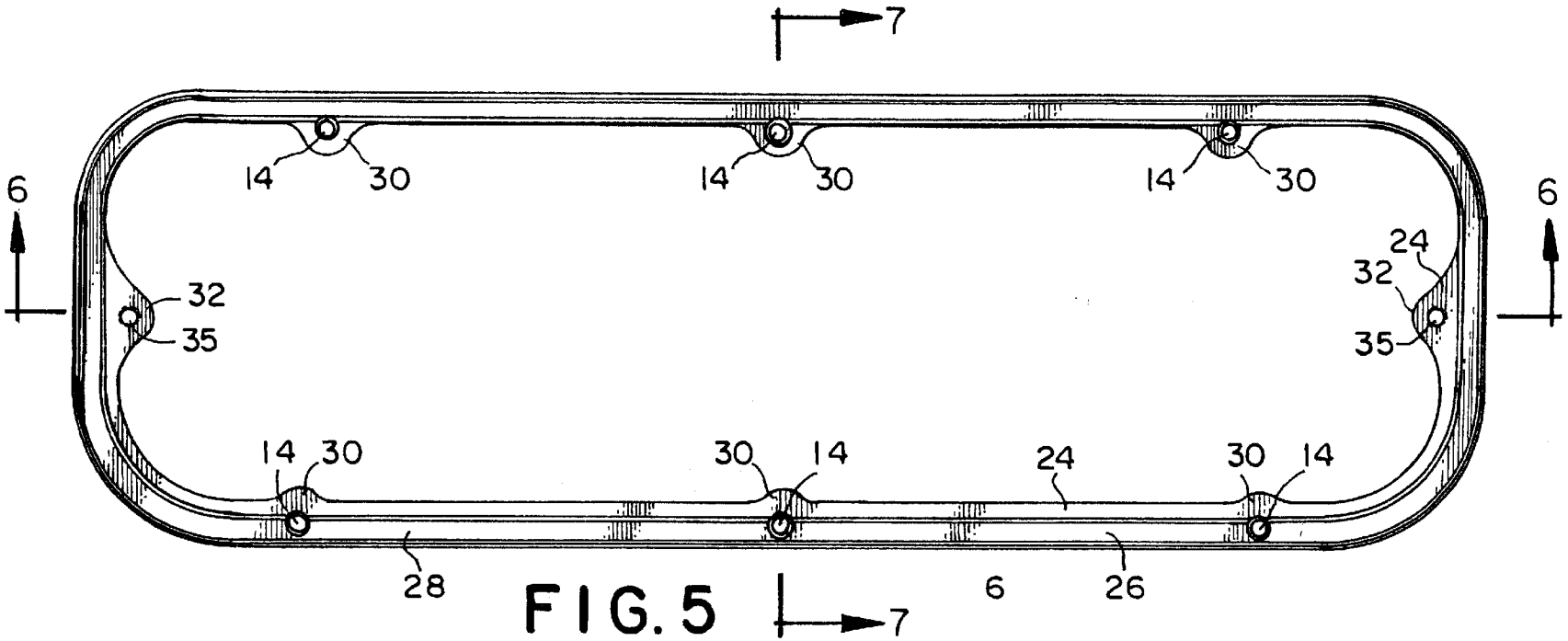
FIG. 5 is a top plan view of the ring adapter.
Figure 6:
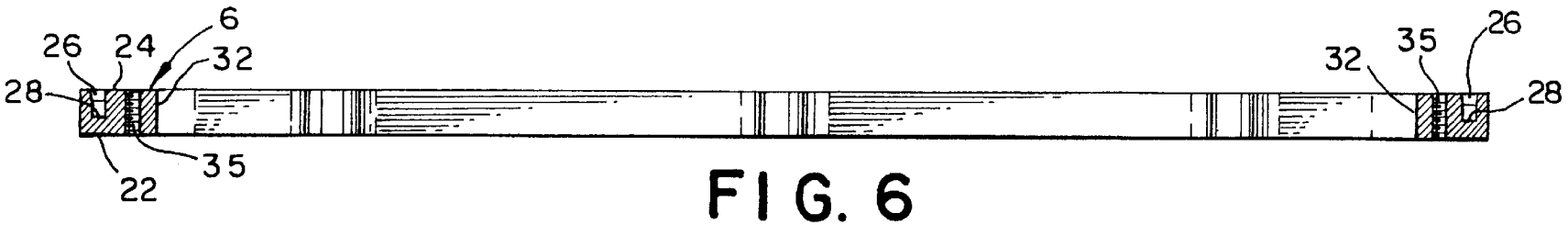
FIG. 6 is a sectional view taken along the plane of the line 6—6 of FIG. 5.
Figure 8:
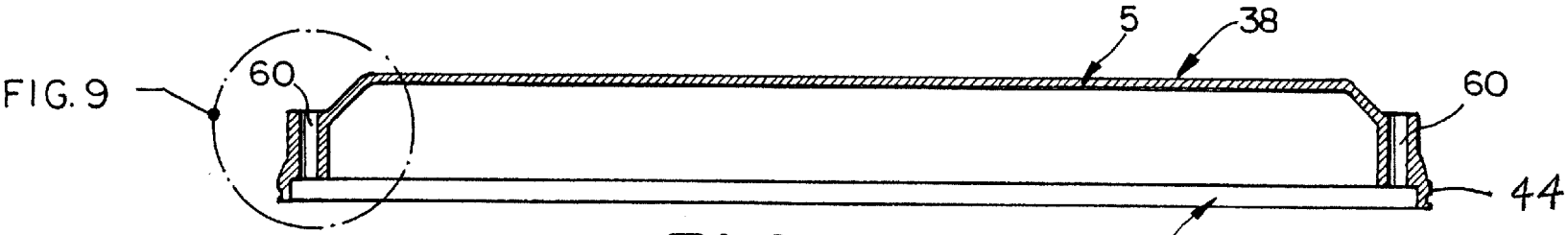
FIG. 8 is a longitudinal cross-sectional view of the cover.

Referring first to the illustrative drawings, on which like or corresponding parts in the several views are similarly numbered, an engine block of type engine is generally indicated by the numeral 2 in FIG. 1A, while another engine block for another type engine is represented by the numeral 2 in FIG. 1B. In each case, the associated engine parts are designated either by the numeral 3 of 3' in those FIGS. 1A and 1B, respectively. The access space between the engine and associated parts 3, 3', which may be minimized by the invention, is designated by the numeral 7 in both FIGS. 1A and 1B. Also, the assembly, comprising the invention, is generally represented by the numeral 4 through the several drawings figures. As seen in FIGS. 3, 5 and 8, the assembly 4 includes the two main parts of the assembly, the removable cover 5 and adapter ring 6.

Figure 2:
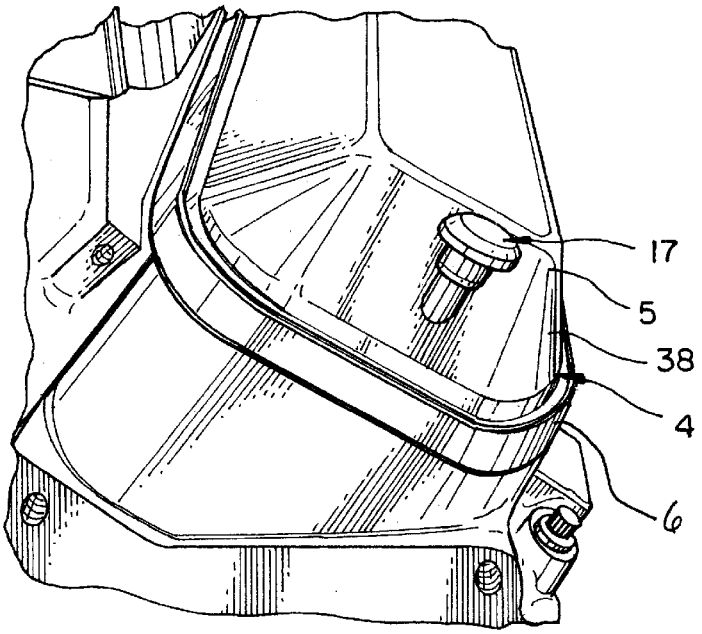
FIG. 2 is an isolated perspective view showing a portion of the valve cover assembly composed of the adapter ring, its mating removable cap, a seal member or O-ring, and a quick release means known in the art.

Generally, the invention is of the assembly 4 generally indicated in FIGS. 1A, 1B and 2, and it is more specifically depicted in FIGS. 3, 5–9. The overall structure of the two primary parts, the adapter ring 6 and the removable mating cover 5, are best seen in FIGS. 5–9.

Figure 4:
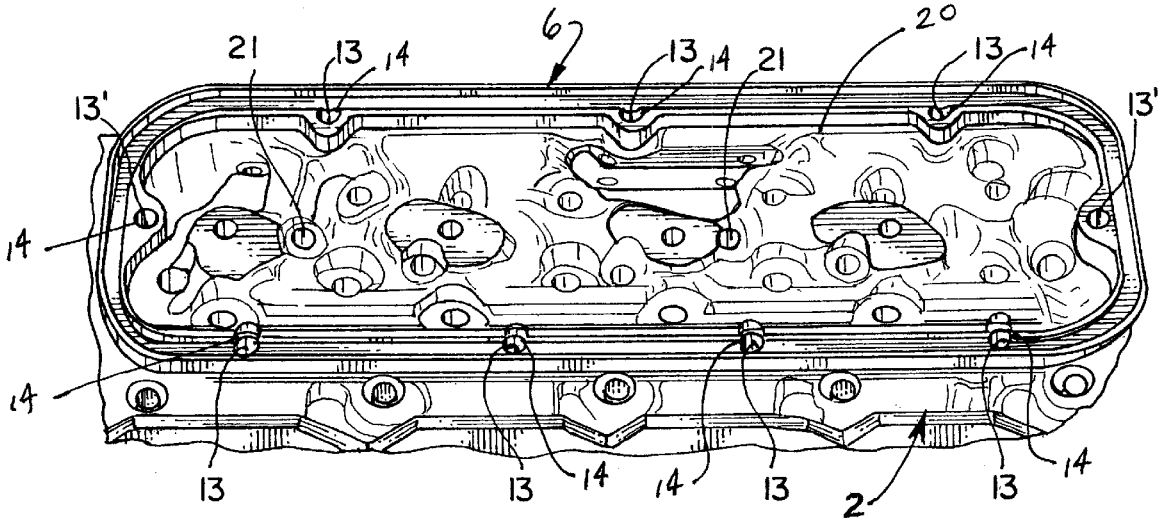
FIG. 4 is a top perspective view showing the adapter ring positioned on the top surface of the engine block surrounding the cylinder recesses.

The adapter ring 6 is configured and of a size to mount to an engine block by bolts 11 and registering recesses 13 in the engine block 2 (see FIG. 4) and mating gasket 15 is captivated between the block 2 and the adapter ring 6. In use, the adapter ring 6 and cover 5 are joined together by quick release fastening means 17 of many conventional types known in the field, such as by an e-clip carrying set of bolts 18 to capture the bolts 18 within hollow bosses formed in opposite ends of the cover 5. Also, a sealing means such as a gasket or an O-ring 19 is captivated between the ring adapter 6 and the cover 5, in assembly 4. In a preferred embodiment, the ring adapter 6 is of oblong configuration or somewhat rectangularly configured and is sized to fit on top of an engine block peripherally, and more particular on a surface 20 encircling a plurality of cylinder recess openings 21 and on a companionate shaped gasket 15 to captivate the gasket between the adapter ring 6 and the engine block surface 20 when bolts 11 are tightened in registered recesses 13 and 14 in the block and ring adapter 6, respectively, as well as through recesses 23 in gasket 15. The ring 6 has a first surface 22 to confront the gasket 15 on the engine block and an opposite second surface 24 confronting the cover 5 upon assembly. This second surface 24 of the ring 6 has a recessed seal groove 26 and, along the length of that groove, spaced ears, such as 30, may be provided either extending inwardly or outwardly to accommodate the recesses 14. Alternatively, the recesses may be located in the groove floor 28 and be of countersunk configuration. Centrally arranged on the shorter ring length are a set of second ears such as that designated by the numeral 32 in opposing relation to one another, each with a through hole 35 to releasably retain the cover 5 in a manner to be explained.

Also in the preferred embodiment, the cover 5 defines a cap portion 38 sized to span the ring adapter in spaced relation; and the cover further includes a skirt portion 40 with a margin zone having a brink edge or terminal end 44. The brink edge 44 is configured to fit in the seal groove 26 of the ring adapter 6, that is, it fits within the groove 26 and bears against the sealing means 19 positioned therein providing a seal. In other words, upon assembly, the brink edge 44 of the cover 5 snugly rests in the seal groove 26 and the sealing means 19, in this case an O-ring, is captivated between the brink edge 44 and the walls of the groove 26 forming a labyrinth seal between the cover 5 and the groove walls of the adapter ring 6.

Figure 9:
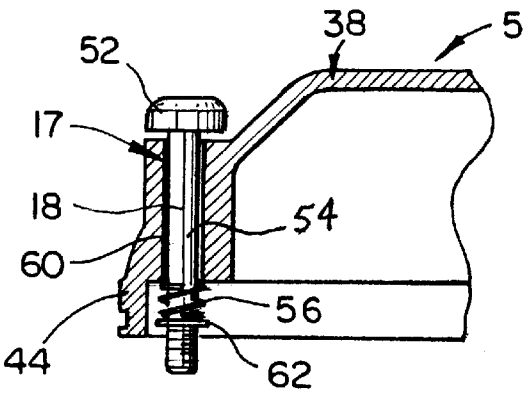
FIG. 9 is an isolated sectional view of one end of the cover showing quick release means fitted thereto for removably attaching the cover to the ring adapter and the engine block.
Figure 7:
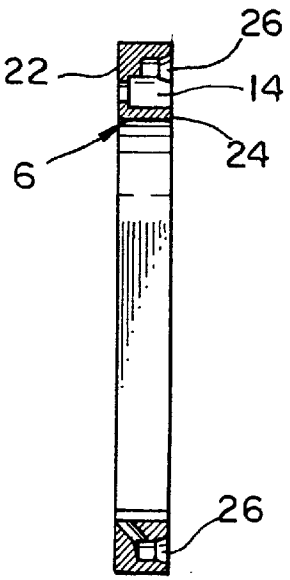
FIG. 7 is a sectional view taken along the plane of the line 7—7 of FIG. 5.

Quick release means 17 interconnect the ring adapter 6 and cover 5 in assembly. Without intending to limit the invention, one type quick release fastener means, in the form of conventional and common e-clip carrying bolts 18, may be used. Referring to FIGS. 3 and 9, each bolt 18 of a pair is received in one of the hollow bosses 60 on a respective opposite end of the cover, with the e-clip 62 or radial enlarged portion captivating the bolts 18 in the respective hollow bosses 60. These bolts, only two in number preferably, extend through the holes 35 of the ring adapter and into threaded engagement with threaded recesses 13 in the engine block, to effectively attach the cover 5 to the ring adapter 6 and engine block 2. The bolts 18 can be quickly manipulated to remove the cover completely from the ring 6.

In use, once the ring adapter 6 of the assembly 4 has been bolted to an engine block 2 and the cover 5 has been attached to the ring adapter 6 and block 2, and the assembly 4 is in the confined access space 7 between the engine 2 and an associated engine part(s) 3, 3', such as an exhaust manifold, rapid access can be had to the space above and near the engine block cylinder openings by removing the cover 5 only and not the ring adapter 6. This is done by manipulating the quick release means 17 and thereafter when the job has been completed, by repositioning the cover 5 and assembling the cover 5 with the ring adapter 6. This is because little access space 7 is required between the engine block 2 and the associate engine parts 3, 3' to accommodate the assembly 4 and all may be accomplished without the use of tools and without disturbing and/or replacing the gasket 15.

Referring to the quick release means 17, an embodiment is described. Other type quick release devices are well known equivalents and are not described herein to avoid being prolix, but reference is made to U.S. Pat. No. 5,598,612, for example, which shows such a device and refers to the other patents of known structures in the field of similar purpose. The drawings illustrate a bolt 18 which is headed as at 52 and which has a shank 54 which passes through the hole in the boss 60 and is captivated therein by the radially enlarged shank portion 62 with a biasing means 56 preferably to bear between the cover and the enlarged portion 62. Wing members or a textured surface on the head 52 may be used to facilitate finger manipulation and application of torque to tighten and loosen the bolt 18. Thus, the quick release means 17 may be said to include manipulation means, which is the head 52 of the bolt 18 whether with or without other manipulation means. It should be noted also that the head 52 of the bolt 18 is in a position to release the cover 5 from the ring adapter 6 through the access space 7 and without the need for tools.

While this invention has been shown and described in what is considered to be a practical and preferred embodiment and is addressed to those skilled in the art to which the subject matter pertains, it will be readily apparent that seeming departures can be made which are, nevertheless, within the spirit and scope of this best mode of the invention; and, therefore, the following claims should not be limited except within and by the doctrine of equivalents.

What is claimed is:

1. A cylinder head assembly for a block of an internal combustion engine having a face with a series of cylinder openings, a pattern of threaded bolt recesses about and outboard of the series of cylinder openings, and a gasket placed about a periphery of said face with through holes to register with the bolt recesses, said assembly comprising:

a ring adapter having a first surface sized and configured to rest on the gasket;

said adapter having a second surface spaced from said first surface and including a peripheral groove in said second surface defined by a groove floor below said second surface and spaced opposite walls extending upwardly from said groove floor to said second surface;

said adapter further including a first pattern of spaced bolt apertures formed therethrough, between said first and second surfaces, and structured and disposed to register in axial alignment with the through holes of the gasket and the recesses in the engine block;

a cover including a cap and a skirt with a marginal zone confronting the adapter ring and structured and disposed to be snugly received within said peripheral groove;

an O-ring normally captivated in said peripheral groove forming a labyrinth seal therebetween; and quick release means removably connecting said cover and said adapter together for rapid disassembly and separation of said cover from said adapter.

2. For an internal combustion engine to be installed on a vehicle, the engine having:

a block with a surface having a series of cylinder openings and a pattern of threaded recesses about a periphery of the surface and surrounding the cylinder openings, said threaded recesses extending into the block from the surface;

associated engine parts connected to the engine in close adjacent relation to the surface and defining a confined access space of predetermined distance between the surface and the associated engine parts, the improvement comprising:

a valve cover assembly comprising:

a ring adapter having a first main surface and a second main surface;

said first main surface being sized and configured to be disposed on the block surface about the cylinder openings and to overlay the pattern of threaded recesses and having a plurality of through recesses structured and disposed to register with the pattern of threaded recesses to allow said ring adapter to be bolted to the engine block;

said second main opposite surface having a peripheral seal groove formed therein and defining a floor below said second main surface and opposing walls extending upwardly from said floor to said second main surface;

a cover of a first predetermined height including:

a cap portion; and a skirt portion;

said cover being sized and configured for mating assembly with said ring adapter;

said skirt portion being sized and configured to be received with said peripheral seal groove, between said walls;

sealing means in said peripheral seal groove for sealing said skirt portion with said ring adapter when in assembly; and quick release means for interconnecting said cover and said ring adapter and for maintaining said cover, said ring adapter and said sealing means in assembly and permitting quick release of said cover from said ring adapter for complete separation of said cover from the engine and said ring adapter for removal through said access space.

3. The assembly as set forth in claim 2 wherein said seal means comprises an O-ring fitted in said peripheral seal groove.

4. A cover assembly for use on an internal combustion engine block having a surface surrounding cylinder openings and a gasket applied to the surface, said cover assembly comprising:

a ring adapter having a first surface sized and configured to rest on the gasket and an opposite second surface including a peripheral groove formed therein, said peripheral groove defined by a groove floor below said second surface and spaced opposite walls extending upwardly from said groove floor to said second surface;

said ring adapter further including means for permitting fixed attachment of said ring adapter to said engine block;

a cover including a cap and a skirt with a marginal zone confronting said ring adapter and structured and disposed to be snugly received within said peripheral groove;

sealing means captivated within said peripheral groove for forming a labyrinth seal between said marginal zone of said skirt and said ring adapter; and quick release means for attaching said cover to said ring adapter and for completely removing said cover from said ring adapter to enable access to the cylinder openings.

5. The cover assembly as recited in claim 4 wherein the cover assembly is configured to be disposed between the engine block and associated engine parts in an access space, and further wherein said cover assembly is structured and disposed to permit separation and removal of said cover through the access space.

* * * * *